US007607556B2

(12) United States Patent
Engelen

(10) Patent No.: US 7,607,556 B2
(45) Date of Patent: Oct. 27, 2009

(54) HOLDER FOR ATTACHING A SPRAYER TO A FLUID CONTAINER

(75) Inventor: Wim Engelen, Vilvoorde (BE)

(73) Assignee: Monsanto Europe S.A., Brussels (BE)

( * ) Notice: Subject to any disclaimer, the term of this patent is extended or adjusted under 35 U.S.C. 154(b) by 412 days.

(21) Appl. No.: 11/340,226

(22) Filed: Jan. 26, 2006

(65) Prior Publication Data

US 2006/0255080 A1 Nov. 16, 2006

Related U.S. Application Data

(60) Provisional application No. 60/647,871, filed on Jan. 28, 2005.

(30) Foreign Application Priority Data

Jan. 28, 2005 (EP) ..... 05447009

(51) Int. Cl.
*B67D 3/00* (2006.01)

(52) U.S. Cl. ..... 222/538; 220/737

(58) Field of Classification Search ..... 248/311.2, 248/309.1, 316.7, 230.1, 74.1; 220/214, 220/DIG. 34, 900, 735–743, 763, 265, 266; 215/250, 251, 253; 222/538, 530, 532, 533, 222/534; 224/148.1, 148.2, 148.7
See application file for complete search history.

(56) References Cited

U.S. PATENT DOCUMENTS 1,411,573 A * 4/1922 McGarrahan ..... 222/538
4,457,445 A * 7/1984 Hanks et al. ..... 220/214
4,588,116 A * 5/1986 Litman ..... 224/672
4,664,301 A * 5/1987 Hoyt ..... 222/538
5,154,324 A * 10/1992 Stratford ..... 222/175
5,531,695 A 7/1996 Swisher
5,558,246 A * 9/1996 Ross, Jr. ..... 220/737
5,772,084 A * 6/1998 Yale et al. ..... 222/402.1
6,223,411 B1 5/2001 Willey
6,269,985 B1 * 8/2001 Brody ..... 222/538
6,412,657 B2 * 7/2002 Riley et al. ..... 222/1
6,508,410 B1 1/2003 Thomas, Jr. et al.
6,702,165 B1 * 3/2004 Ramirez ..... 224/199
2003/0066846 A1 4/2003 Dimeglio
2004/0026576 A1 * 2/2004 Shibuya ..... 248/62
2004/0164105 A1 * 8/2004 Stern ..... 222/538
2005/0082389 A1 * 4/2005 Sanchez et al. ..... 239/332

FOREIGN PATENT DOCUMENTS

DE 92 10 226.3 11/1992

* cited by examiner

*Primary Examiner*—Lien T Ngo
(74) *Attorney, Agent, or Firm*—Senniger Powers LLP

(57) ABSTRACT

The present invention is related to a holder for holding a sprayer, and to a combination of a container and such a holder and sprayer. The holder is characterized by the presence of a securing strip integral to the holder, for securing the sprayer prior to its first use. The holder is preferably equipped with a means for closing the strip in an essentially non-removable way.

7 Claims, 4 Drawing Sheets

HOLDER FOR ATTACHING A SPRAYER TO A FLUID CONTAINER

FIELD OF THE INVENTION

The present invention is related to containers provided with a means for attaching a sprayer to the container, when the sprayer is not in use.

STATE OF THE ART

Sprayers for distributing pesticides or other fluids are often provided together with a large container to which the sprayer can be connected through a tube, so that liquid present in the container may be pumped up and sprayed. Documents U.S. Pat. No. 6,508,410 and EP-A-583902 show examples of this kind of combination, in particular of the way in which the sprayer is attached to the container, when the sprayer is not in use. The first document shows a mounting member installed underneath the screwed-on cap, into which member the sprayer can be inserted. The second document shows a container with a recess in its side, so that a sprayer with a suitable form may be placed in the recess. Neither of these systems provides a means for securing the sprayer before its first use. This problem is related to the displaying of the products in stores or supermarkets, where it is to be avoided that customers take the sprayers out of the holder. With the systems described above, a security against theft of the sprayers is not provided. Furthermore, even if a person puts the sprayer back, there is no proof that the product has been tampered with.

One product which is currently on the market takes a first step towards solving this problem. This is the 'Triple Strike' Grass&Weed Killer from Spectracide, currently available on the US-market. This product provides a holder removably attached to the side of the container. The sprayer is inserted in the holder and secured with two plastic strips. The strips cannot be removed without being cut, so this product does provide some security against theft, along with proof that it has been tampered with.

However, placing the strips, which are separate from the holder, is quite an elaborate action, which complicates the assembly of the product and therefore increases the production cost.

AIMS OF THE INVENTION

The present invention aims to provide a holder to be attached to a container for securing a sprayer to the side of the container, which allows to see evidence that the product has been tampered with, and which is also easier to assemble.

SUMMARY OF THE INVENTION

The present invention is related to products such as described in the appended claims.

SHORT DESCRIPTION OF THE DRAWINGS

DETAILED DESCRIPTION OF A PREFERRED EMBODIMENT OF THE INVENTION

Figure 1:
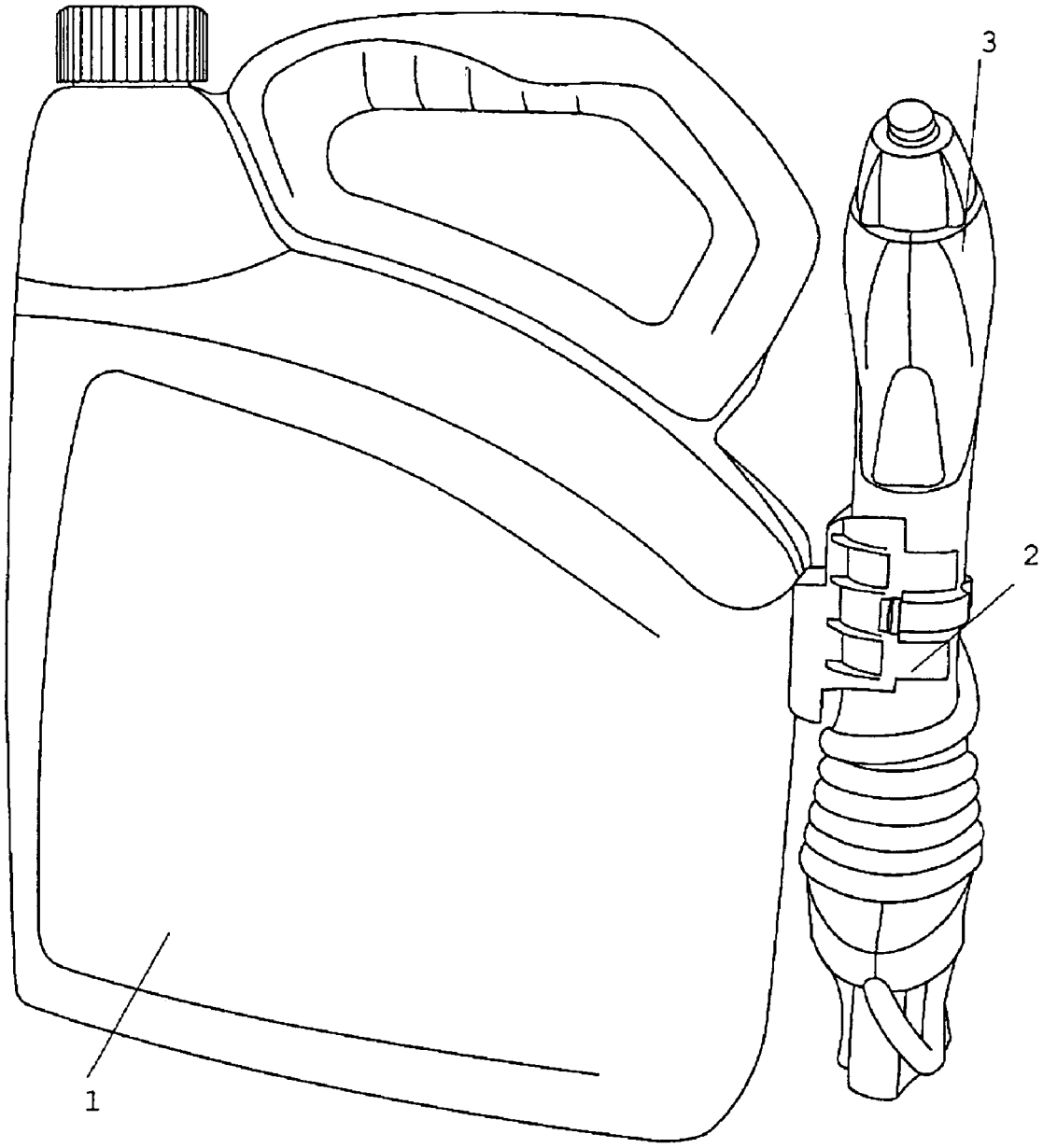
FIG. 1 represents a view of the assembly of a container and a sprayer, using a holder according to the invention.

FIG. 1 shows an assembly of a container 1, with a holder 2 attached to the side, and a sprayer 3 inserted and secured in said holder. The invention is related to the holder 2, to the combination of the container and holder, and to the combination of container, holder and sprayer.

Figure 2:
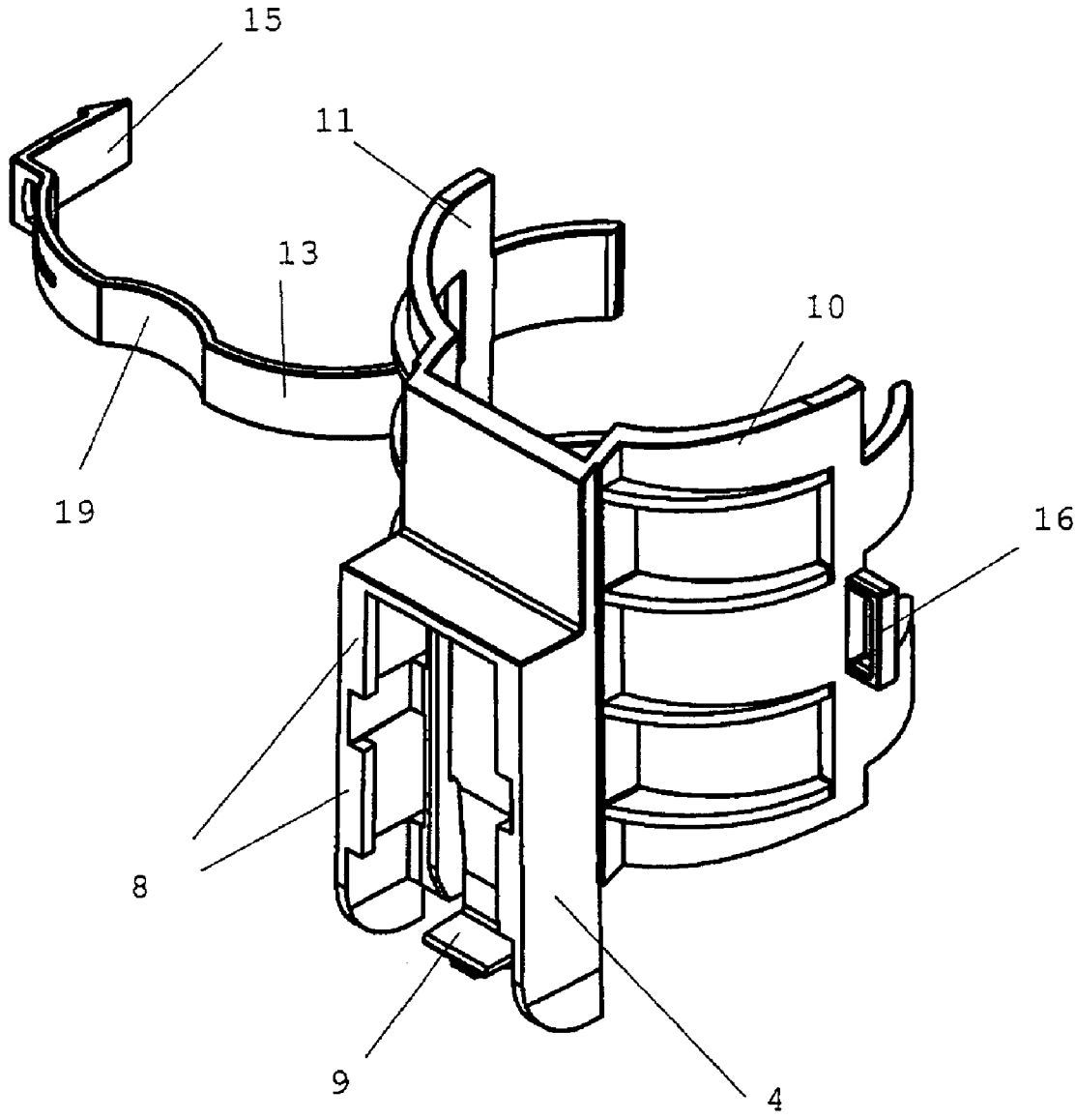
FIG. 2 represents a detailed view of the holder.
Figure 3:
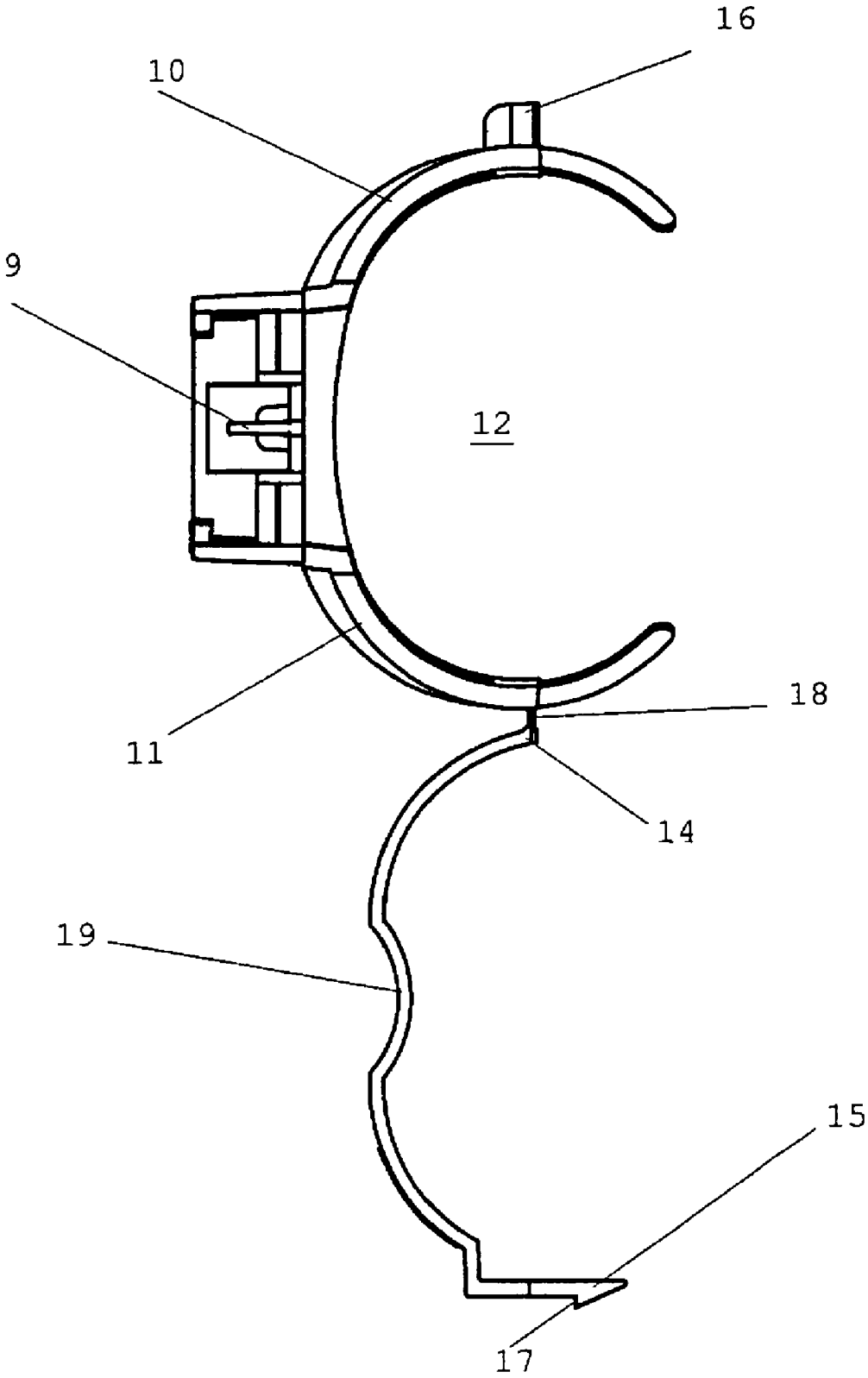
FIG. 3 represents a plan view of the holder.
Figure 4:
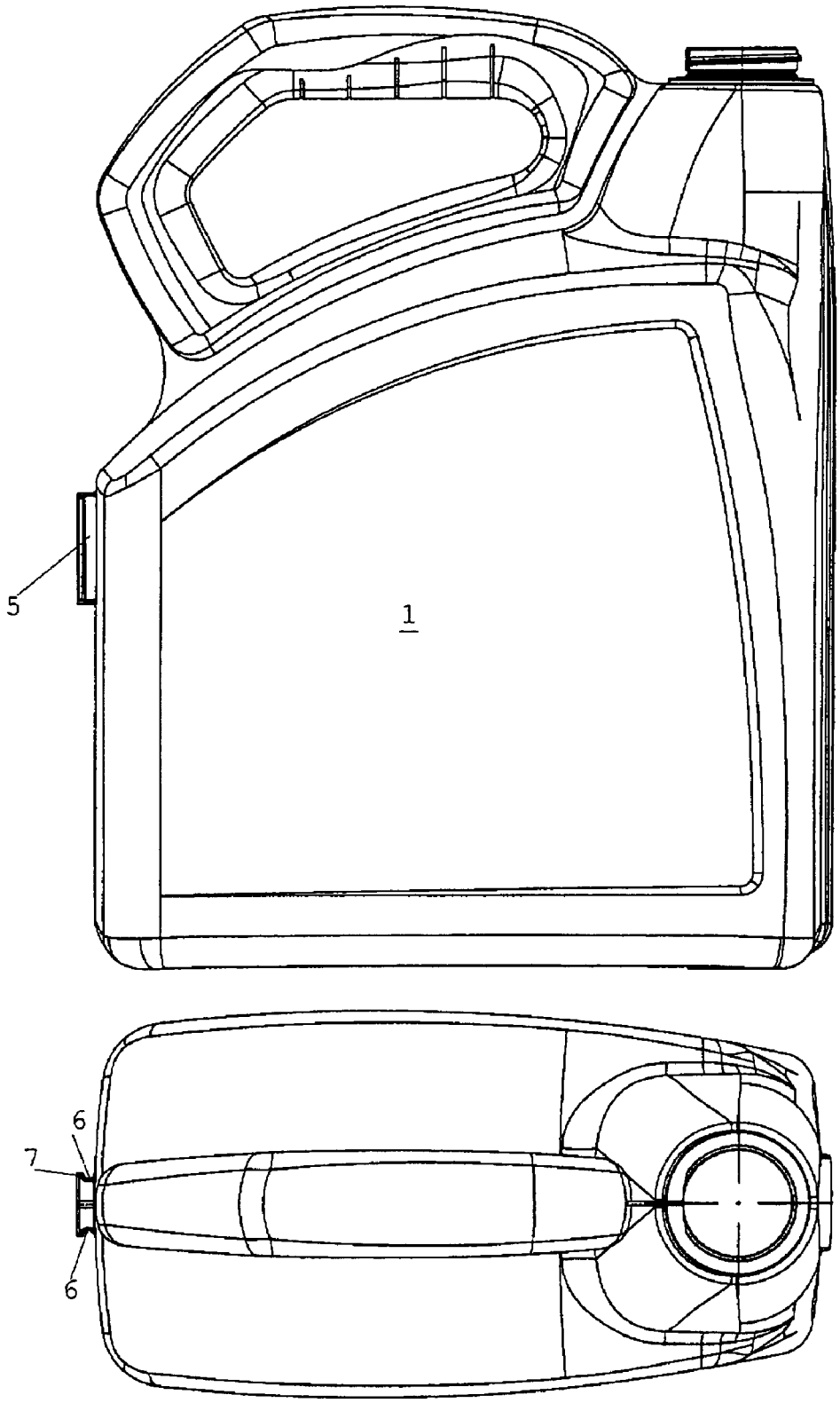
FIG. 4 represents a frontal view and plan view of the container.

The holder 2 according to the preferred embodiment of the invention, is shown in detail in FIG. 2. A plan view as seen from the direction of the arrow in FIG. 2, is shown in FIG. 3. The holder is a plastic piece, preferably made of PolyPropylene PP MOPLEN-EP440N or PP ADSTIF-HA740N (both from Basell). The holder comprises a central part 4 which is to be attached to the container. In the embodiment of FIG. 2, this part is a rectangular or trapezium shaped, casing-like part 4, which can be slid over a rectangular or trapezium-shaped protrusion 5 on the side of the container, see FIG. 4. The protrusion 5 has a narrow section 6 which is smaller in circumference than the top surface 7, so that the lips 8 of the holder are able to catch the sides of the protrusion. The holder is then finally clicked on by a bendable securing portion 9, which bends back when the holder is pushed down over the protrusion, and finally grabs the bottom rim of the protrusion, thus securing the holder to the container. Once the holder is attached to the container, it can be removed by bending back the securing portion 9 and sliding the holder upwards.

The body of the holder consists of two rounded portions 10 and 11, extending away from the container, and portion-way encircling the space 12 into which the sprayer is to be placed. To one of these rounded portions is connected a securing means 13, which is a plastic strip, attached and integral to one of the rounded portions 11 at one end 14, and comprising an arrow-like end portion 15 at its other end. The arrow-like end portion can be inserted into an opening 16 present on the other rounded portion 10. The shape and material of the arrow-like end portion 15 and the opening 16 are such that the securing strip can be fixed by inserting the arrow-like end portion into the opening, until the straight part 17 of the arrow has passed through the opening, but the securing strip cannot be easily removed by the opposite movement, i.e. by moving the arrow-like end portion backwards through the opening. Generally, the arrow-like end portion 15 and the opening 16 provide a means for one end of the securing strip to be attached in an essentially non-removable way to one of the rounded portions 10,11. In other words, the connection can be made by one action, in this case inserting the arrow 15 in the opening 16, but it cannot easily be undone by the reverse action. It is clear that other closing systems with the same effect might be employed in stead of the arrow/opening combination of the preferred embodiment.

The strip 13 is essentially a means to secure the sprayer before its first use. To remove a sprayer present in the holder, it is necessary to break off the securing strip. To this aim, the preferred embodiment shows a connection 18 between the strip and the rounded portion which is made sufficiently thin so that it can be broken off by hand. This way, the securing strip serves as a security against theft in the shops. Since taking out the sprayer requires breaking the strip, the product provides proof of tampering, in case the sprayer has been removed and subsequently replaced. Most importantly, the securing strip 13 is integral with the holder. In the production process, placing a sprayer attached to the container requires not more than three actions:

attaching the holder over the protrusion 5 of the container, placing a sprayer in the space between the rounded portions 10 and 11, clicking the arrow-like end portion 15 into the opening 16.

The last step replaces the multiple actions required when the sprayer is to be secured by separate plastic strips, and thus allows to simplify the production process.

According to the preferred embodiment, the securing strip 13 is provided with a central indentation 19, which will ensure a lateral pressure is exerted on the sprayer, when it is placed in the holder, thus helping to keep the sprayer in place.

The above merely describes the preferred embodiment. The main aspect of the invention concerns a holder with a securing strip 13 which cannot be easily opened without breaking the strip, and wherein the strip 13 is integral with the holder. The shape of the holder and the way in which it is attached to the container may differ from the above embodiment, without departing from the main scope of the invention.

The invention claimed is:

1. A holder for holding a sprayer when the latter is not in use, the holder comprising:

a body;

a strip having a first end integrally formed with the body and a second end connectable to the body, wherein the strip is adapted to hold the sprayer between the strip and the body when the second end of the strip is connected to the body, wherein said body comprises a central part adapted for attachment to a container, and first and second portions extending away from the central part and forming a space in which the sprayer is held between the strip and the body, wherein said strip is integral with the first portion at the first end of the strip, and wherein said strip comprises a connector at its second end adapted to be essentially non-removably attached to the second portion, wherein the first end of the strip is connected to the first portion of the body by an integrally formed breakable connection that is sufficiently thin for it to be breakable by hand.

2. The holder of claim 1, wherein the connector at the second end of the strip comprises an arrow-like end portion at, and wherein the second portion includes an opening in which said arrow-like end portion is configured to be inserted to essentially non-removably attach the second end of the strip to the second portion.

3. The holder of claim 1, wherein said strip further comprises an indent, for exerting a lateral pressure on the sprayer when the sprayer is secured to the holder.

4. The holder of claim 1, said body and said strip being produced from PolyPropylene PP MOPLEN-EP440N or PP ADSTIF-HA740N.

5. The holder of claim 1 in combination with a container, the body of the holder being attached to the container.

6. The holder of claim 5, in further combination with the sprayer secured between the strip and the body of said holder, the second end of the strip being essentially non-removably connected to the body.

7. The holder of claim 6, wherein the container comprises a protrusion, the holder being secured to the protrusion by sliding the holder over the protrusion.

* * * * *